United States Patent [19]

Tapp et al.

[11] Patent Number: 4,576,230

[45] Date of Patent: Mar. 18, 1986

[54] RETRIEVABLE SUBSURFACE WELL CASING SLIP AND PACKER APPARATUS AND METHOD

[76] Inventors: William T. Tapp, Rte. 2, Box 119E2, Yorktown, Tex. 78164; Ranson R. Fullinwider, 15922 Haven Hills, Houston, Tex. 77084

[21] Appl. No.: 731,592

[22] Filed: May 6, 1985

Related U.S. Application Data

[63] Continuation of Ser. No. 555,945, Nov. 29, 1983, abandoned.

[51] Int. Cl.[4] ..... E21B 23/00; E21B 33/129

[52] U.S. Cl. ..... 166/382; 166/138; 166/216

[58] Field of Search ..... 166/382, 381, 387, 134, 166/138, 139, 207, 216, 240

[56] References Cited

U.S. PATENT DOCUMENTS

| | | | |
|---|---|---|---|
| 2,136,047 | 11/1938 | Fulkerson | 166/138 |
| 2,805,723 | 9/1957 | Young | 166/138 |
| 2,832,422 | 4/1958 | Cross, Jr. et al. | 166/216 |
| 3,115,189 | 12/1963 | Althouse, Jr. et al. | 166/138 |
| 3,179,180 | 4/1965 | Hart | 166/216 |

*Primary Examiner*—Stephen J. Novosad
*Assistant Examiner*—Thuy M. Bui
*Attorney, Agent, or Firm*—Cox & Smith Inc.

[57] ABSTRACT

A retrievable subsurface well casing slip and packer apparatus and method having upper and lower interconnected and expandable slips which have a combined circumferential engagement of a well conduit greater than or equal to 360° and a control means for releasing engaging means for engagement with a well bore and permitting rotation of a running string in clockwise and counterclockwise directions without releasing the engagement means for setting the apparatus in a well bore.

14 Claims, 20 Drawing Figures

RETRIEVABLE SUBSURFACE WELL CASING SLIP AND PACKER APPARATUS AND METHOD

This application is a continuation of co-pending application Ser. No. 555,945, filed on Nov. 29, 1983 now abandoned.

BACKGROUND OF THE INVENTION

The invention relates to a retrievable subsurface well casing slip and packer apparatus and method. In particular the invention relates to a slip apparatus and method for anchoring a tool within a well casing and a packer apparatus and method for sealing off a well casing with a tubing or production string. The invention further relates to a locking, setting and unsetting mechanism for a slip or packer apparatus and method which is reliable, durable and economical to manufacture.

Retrievable subsurface well casing slip and packer apparatus are well known in the prior art. An example of such a tool is shown in U.S. Pat. No. 3,507,327 issued to D. V. Chenoweth, which is incorporated herein in to by specific reference thereto for all purposes. In practice a slip and packer apparatus is lowered down a well casing to a desired position below the surface and locked with the well casing and packed off to provide a seal. A typical method of doing this is by attaching the slip and packer apparatus to a running or production string which is run down the well casing by connecting joints of tubing which are of lesser diameter than the well casing. A known method of setting the apparatus in position to which this invention relates is the manipulation of a running string to set and pack off a tool and to unset and unpack the tool for removal. This is achieved with the apparatus disclosed in the Chenoweth patent by rotation and vertical movement of the running string which effects setting of the slip apparatus and packing-off of the packing apparatus. In the case of the Chenoweth patent the apparatus is maintained in its locked running-in position by not rotating the tubing string when it is positioned in the well casing until it is desired to set and pack it off. Rotation of the running string in one direction unlocks the Chenoweth apparatus from its non-engaging, locked, running-in position so that continued lowering of the running string will provide for engagement of the slip apparatus to set the tool in a desired position within a well casing. When it is desired to release the Chenoweth tool, the running string is rotated in the same direction which will disengage the packing apparatus and the slip apparatus so that the running string and tool may be removed from the well casing.

During the running-in operation it may be desirable to rotate the running string in both directions to facilitate lowering and positioning in the well casing. Rotation of a running string to which the Chenoweth apparatus is attached in the direction opposite of the unlocking direction and releasing direction may result in jamming of the apparatus which requires removal of the tool from the well casing for resetting.

The Chenoweth patent also discloses a slip apparatus which includes upper and lower slips and a separate interconnecting slip ring which prevents relative longitudinal movement between its upper and lower slips. This requires a separate part for the slip ring which retains upper and lower slips.

It is also known in the prior art to provide a J-slot locking and setting mechanism for a slip and packing apparatus to prevent unlocking of the tool from its running-in position and whereby it can be set and packed off. Examples of retrievable packer systems which use a J-lock are those manufactured by Otis Production Packer Equipment And Services and Dresser-Guilberson. Another example of a packer system which uses a slot and pin is that used by Arrow Oil Tools, Inc. which uses J-pins to allow setting and release of the tool. A disadvantage of a J-slot in setting a tool is that the packer may be over stressed to set the tool in its engaging position.

It is also known to have upper and lower slips which are interconnected without a slip ring. A retrievable packer made by AVA International utilizes a slip system having vertically spaced upper and lower slips which are directly connected to each other. Each upper slip utilizes a key-member which meshes with a T-slot in the lower slip which is directly below the upper slip.

It is an object of the present invention to provide a slip and packer apparatus which may be run into a well casing and whereby the running string may be rotated in either direction during running without release and unlocking of the slip and packing apparatus for setting. It is a further object of the invention to provide a positive locking means for a slip and packer apparatus to prevent accidental unlocking. It is a further object of the invention to provide a slip and packer apparatus which has interconnecting slip means which are directly connected and which provide a circumferential gripping area greater than 360°. It is a further object of the invention to provide a slip and packer apparatus and method which is reliable, durable and economical to manufacture. The apparatus and method of the invention further includes other advantages and additional objects will be apparent from the following detailed disclosure of the preferred embodiment.

SUMMARY OF THE INVENTION

The invention relates to a retrievable subsurface slip and packer apparatus and method which includes a control means for releasing and locking the tool from its running-in position for engagement with a well conduit and which permits rotation of the running string in clockwise and counterclockwise directions without releasing the tool for setting in a well bore and which permits relocking the tool after disengagement. The apparatus further includes upper and lower well bore engaging means or slips which are directly interconnected to limit relative longitudinal movement between the upper and lower engaging means while permitting radial expansion and retraction of the upper and lower engaging means to engage and disengage a well conduit with a circumferential gripping area greater than 360°.

BRIEF DESCRIPTION OF THE PREFERRED EMBODIMENT

Figure 1B:
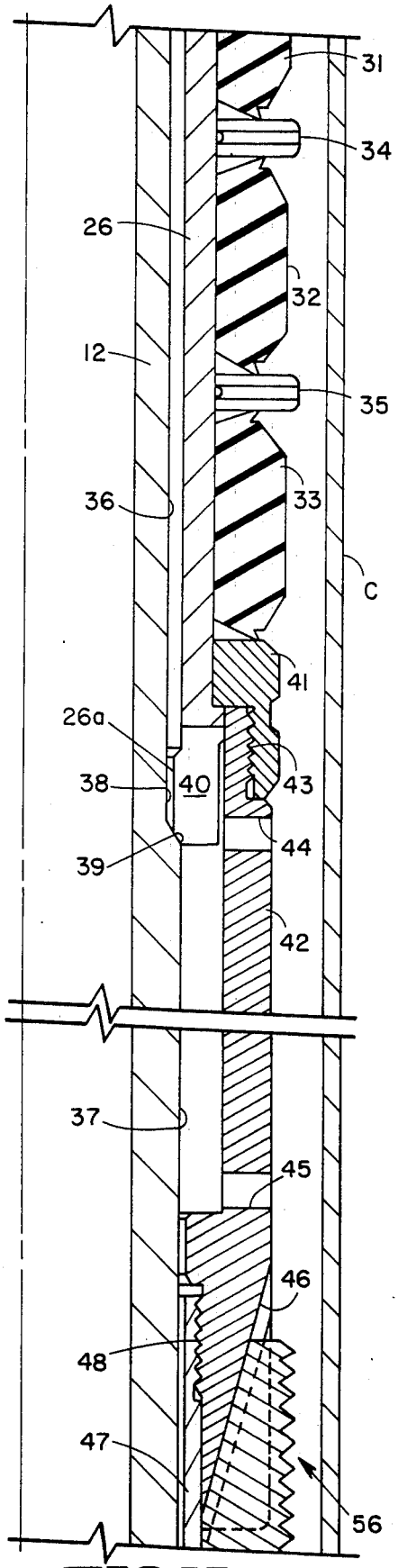
FIGS. 1*a*, 1*b*, 1*c* and 1*d* are cross-sectional views of the apparatus in its running-in position.

Referring to FIGS. 1*a*–1*d* of the invention, there is shown an embodiment of a retrievable subsurface well casing slip and packer apparatus. The apparatus includes a cylindrical top sub 10 having a box joint at its upper end with screw threads 11 for connecting with a section of a running string (not shown). The top sub 10 is connected to an elongated generally cylindrical mandrel 12 having a pin joint at its upper end with connecting thread means 13 for securing the mandrel to the top sub 10. An O-ring 14 is inserted in circumferential slot 15 in the top sub assembly to provide a seal. Set screw 10*a* secures the top sub 10 from rotation relative to the mandrel 12 to prevent loosening of thread means 13.

A brass bearing ring 16 is provided between the lower surface of the top sub 10 and a bearing retainer 17. Positioned below the bearing retainer 17 is a seal means 18 including retainer rings 19 and 20 and cylindrical elastomer seals 21 and 22. The outer surface of the mandrel 12 is stepped to provide an increased cross sectional surface 23 which retains the seal means 18 in position when the apparatus is in its set position as shown in FIGS. 2*a*–2*d*.

Cylindrical seal housing 24 having inner sealing surface 25 is connected to an elongated cylindrical packing mandrel 26 by threaded connection means 27. An O-ring 28 provides a seal between this seal housing 24 and the packing mandrel 26. A cylindrical gage ring 29 is mounted on the seal housing 24 through thread connection means 30.

Mounted below the gage ring 29 are a plurality of cylindrical elastomer members or engagers 31, 32 and 33 which are separated by packer element spacer means 34 and 35.

The outer surface 36 of elongated mandrel 12 is provided with external upset 38 which, when engaged by the inclined surface 39 of packing mandrel 26, prevents downward movement of packing mandrel 26 relative to elongated mandrel 12 as viewed in FIGS. 1*a*–1*d*. Movement of the packing mandrel 26, due to engagement by the enlarged portion 26*a* of the packing mandrel 26, upward relative to the mandrel 12 as viewed in FIG. 1 is permitted as shown in FIGS. 1*a*–1*d* and which is explained more fully hereinafter. A cutout 40 is provided in the enlarged portion 26*a* of the packing mandrel 26 to allow equalization of pressures through fluid flow on each side of the packing mandrel 26.

A guide ring 41 is releasably connected to the upper expander means 42 by thread connection means 43. The guide ring 41 engages upset portion 26*b* to connect the guide ring 41 to packing mandrel 26. A plurality of apertures 44 and 45, two of which are shown in FIGS. 1*a*–1*d* are provided around the circumference of upper expander means 42 to further permit equalization of pressure on both sides of the packing mandrel 26.

Figure 7:
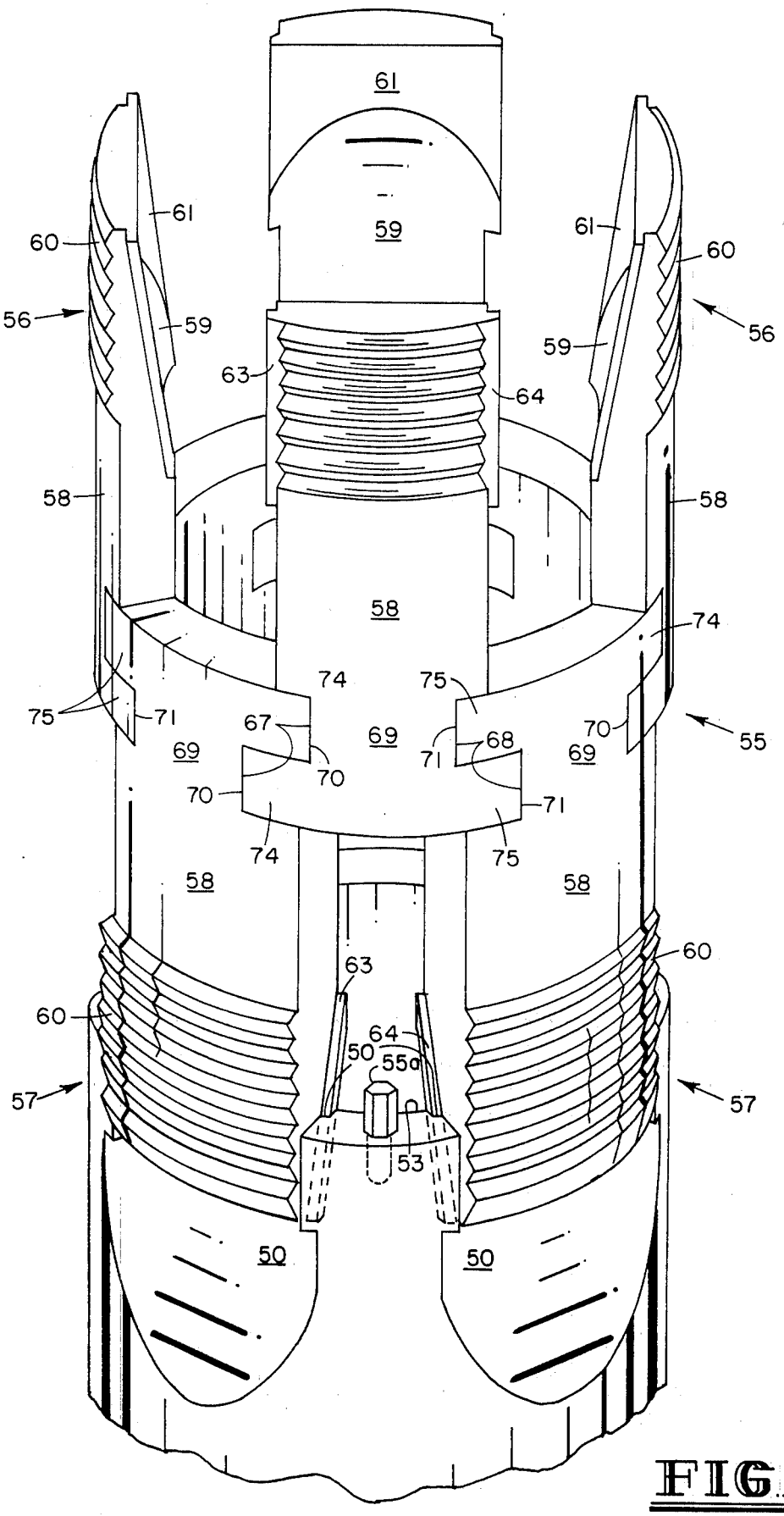
FIG. 7 is a side view partially broken away showing the interconnection of the upper and lower slips.
Figure 8:
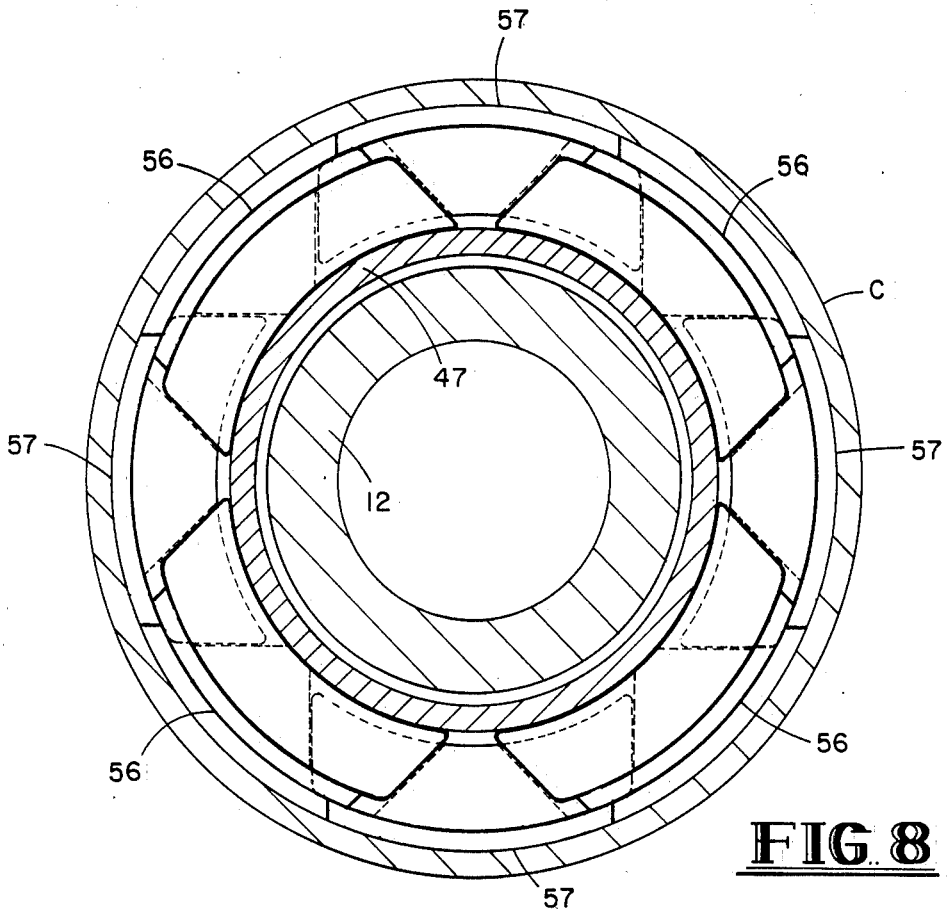
FIG. 8 is a cross-sectional view looking downwardly showing the slips partially engaged.

The upper expander means 42 includes a plurality of inclined camming surfaces 46 spaced around the outer surface of the expander means. An elongated cylindrical slip support sleeve 47 is connected to the upper expander means 42 by thread connection means 48. An upset portion 51 on the bottom of the slip support sleeve 47 includes an engaging surface 52 which engages surface 53 on the bottom expander means 49 which includes plural inclined camming surfaces 50 spaced around the outer surface of the expander means as shown in FIG. 7. A plurality of circumferentially spaced slots 51 (one being shown) facilitates assembly. As will be apparent the bottom expander means 49 may move upward relative to the slip support sleeve 47 as the surface 53 of the bottom expander means 49 slides upon the outer surface 54 of the slip support sleeve 47. Stop bolts 55*a* shown in FIG. 7 limit movement of the upper expander means 42 and bottom expander means 49 toward each other as explained hereinafter.

The slip or engaging means 55 is mounted between the inclined plural camming surfaces 46 and 50. The slip means includes a plurality of upper and lower interlocked slips or engagers 56 and 57 having teeth means 60 which move outwardly to engage a casing C. Each of the slips is identical in construction and is best shown in FIGS. 3*a*, 3*b*, 3*c*, 3*d*, 3*e*, and 3*f*. Each slip includes an outer surface 58 and an inner arcuate surface 59. A plurality of arcuate teeth or gripping members 60 are provided on the outer surface of each slip to engage the inner wall of the well casing and lock the apparatus with a well casing. An inclined camming surface 61 is provided on the inside of each to engage either the inclined camming surfaces 46 or 50 to provide the outer radial movement. Retaining members 63 and 64 form a dovetail and slide in mating grooves in the upper and bottom expander means 42 and 49 to retain each of the slips to the upper and bottom expander means 42 and 49. Camming surfaces are provided on the upper expander means 42 and lower expander means 49 to engage upper slips 56 and lower slips 57 as more fully explained below.

An interconnecting means 65 at one end of the slip includes a neck means 66. The neck means 66 includes inclined surfaces 67, 68 and outer arcuate surface 69. The interconnecting means 65 also includes ears 70 and 71. Engaging surfaces 72, 73, 74, 75, 76 and 77 are provided to provide the direct interconnection between the plurality of upper and lower slips when they are positioned around the slip support sleeve 47. As will be apparent, relative movement of the upper expander means 42 toward the bottom expander means 49 will cause outward radial movement of the plurality of slips. The surfaces 72–77 limit relative longitudinal movement between the upper and lower slips and permit radial and circumferential expansion and retraction of the upper and lower slips to engage and disengage a well casing such as well casing C. The combined circumference of the teeth 60 are equal to or greater than 360 degrees because of the interconnection design. This provides additional gripping surface between the slip and the casing to spread the surface load over a greater area and avoid damage to the casing when the slips are set in position in engagement with the casing. The stop bolts 55*a* engage stop surface 62 to limit movement of the expander means. The interconnecting means allows engagement of the upper and lower engagers the well conduit without skidding of the engagers with the well conduit.

The bottom expander means 49 includes a plurality of circumferentially spaced apertures with aperture 78 being shown. These apertures provide for pressure relief so there is equalization of pressures of fluid contacting the outer surface of the mandrel 12 and inner surface of casing C. The bottom expander means 49 is connected to drag block housing 79 through threaded connection 80. A plurality of drag blocks 81 are mounted for radial movement on the drag block housing 79 shown in FIGS. 1*c*–1*d* and FIGS. 4 and 6. Drag block leaf springs 82 maintain the drag blocks 81 in the outwardly biased position so that the drag surface 83 engages the surface of casing C. This frictional contact tends to resist longitudinal and rotational movement between the drag blocks 81 and the inner surface of the casing as more fully explained hereinafter. Ears 81*a* limit the outer radial movement of the drag blocks and retain them in the slots 79*a* in drag block housing 79.

Figure 5:
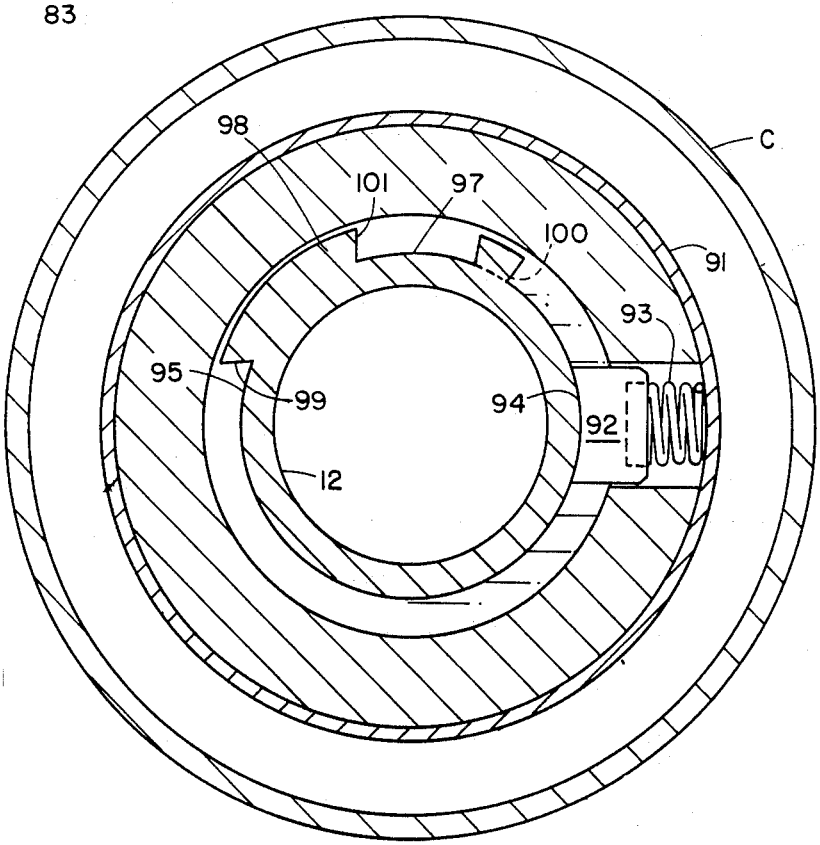
FIG. 5 is a cross-sectional view showing the locking means for releasing and setting the tool.
Figure 6:
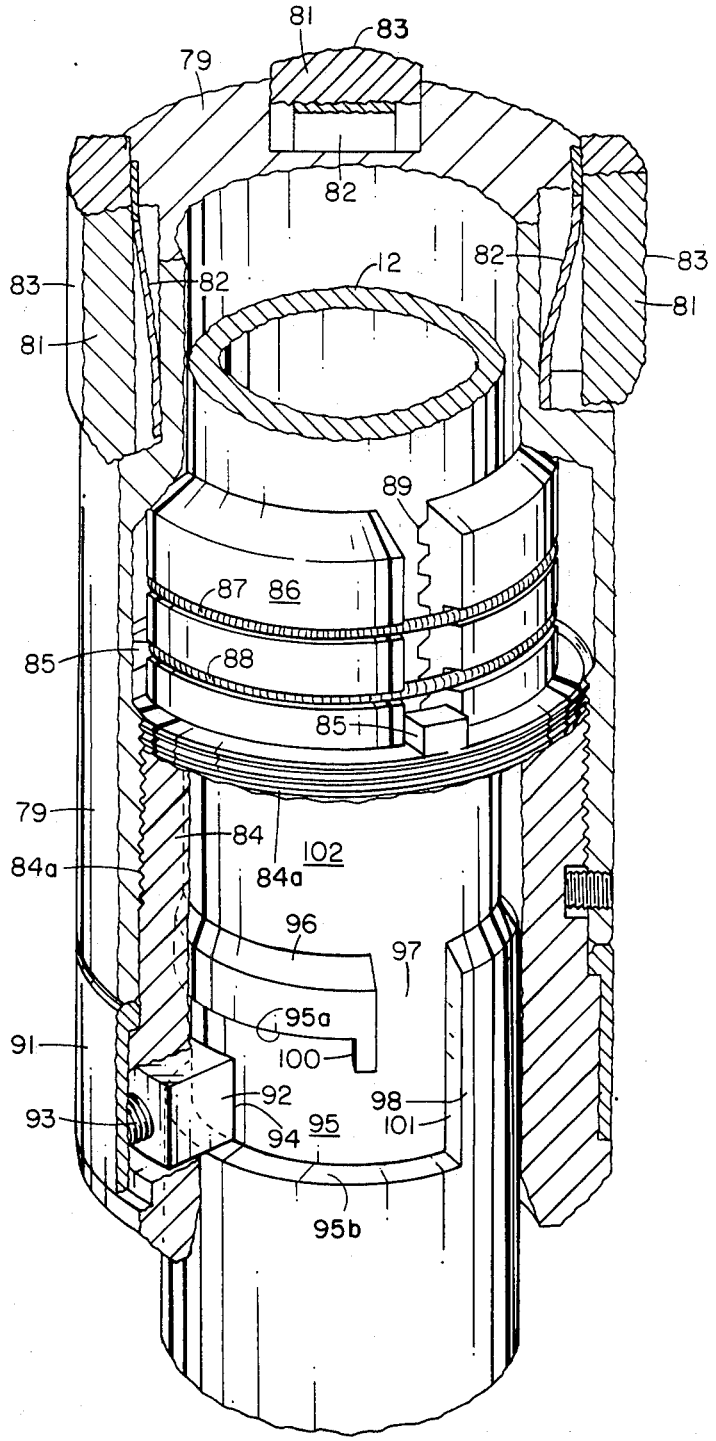
FIG. 6 is a side view, partially broken away, showing the locking and releasing means.

As best shown in FIGS. 1*d*, 2*c*, 2*d* and 6, a cylindrical key housing 84 is connected to the drag block housing 79 through thread connection means 84*a*. The key housing 84 includes a plurality of locating lugs 85 as shown in FIG. 6 at the upper surface thereof. Slideably mounted within the annulus formed by the drag block housing 79 and the mandrel 12 are a plurality of segments 86. The four segments are generally arcuate and are retained in contact with the outer surface of the mandrel 12 by garter springs 87 and 88. A four lead left hand buttress thread 89 is provided on the inner surface of each segment 86. The thread 89 mates with a similar four lead left hand buttress thread 90 on the outer surface of the mandrel 12 as more fully explained hereinafter. As shown in FIG. 6, a cylindrical key retainer 91 is connected between the drag block housing 79 and the key housing 84. The key retainer 91 retains a key 92 within a mating aperture in the key housing. A key spring 93 biases the key 92 inwardly so that its inner arcuate surface 94 engages the outer surface of the mandrel 12. The key 92 is generally square in vertical cross section. A circumferential slot 95 is provided in the mandrel for receiving the key 92. An upset portion 96 provides a ramp which biases the key 92 outwardly as more fully explained hereinafter. The slot 95 and upset portion or ramp 96 does not extend 360 degrees but rather includes a removed portion 97 which permits upward movement of the key 92 out of the slot 95. Stop means 98, as shown in FIGS. 5 and 6, limits rotational movement of the key 92 relative to the mandrel 12. The key 92 is positioned in a locked position when it engages the surfaces 99 and 100 of the stop 98. In order to remove the key 92 from the slot 95 it is necessary to rotate the mandrel 12 relative to the drag block housing 84. The drag blocks 83 which are in frictional engagement with the casing cause relative movement between the key 92 and the mandrel 12 when the mandrel 12 is rotated by rotating the running string. The key 92 will rotate until it engages the second stop surface 100 assuming the key 92 is in engagement with the surface 95*a*. In order to fully release the key 92 from the slot 95 it is necessary to slightly raise the mandrel 12 which will move the stop surface 100 above the key 92. Further rotation of the mandrel 12 will engage key 92 with third stop surface 101. Upon lowering of the mandrel 12 the key 92 leaves the slot 95 on surface 97 and slides upon the outer surface 102 of the mandrel 12.

The method of operating the apparatus to set it in a casing is as follows. A running string is connected to the top sub 10 through the thread means 11. The apparatus is then lowered into a casing C by adding sections to the running string until it is positioned at a desired location. The apparatus is lowered slightly below the desired set point. The running string is then picked up slightly to lift the mandrel 12. The stroke used to do this is approximately six inches at the tool. The drag blocks 81 have their drag surfaces 83 in engagement with the inner surface of the casing. Accordingly, upward movement of the running string which in turn provides upward movement of the mandrel 12 provides relative motion between the mandrel 12 and the drag block housing 79. The slot 95 moves upwardly relative to key 92 as shown in FIG. 6 until its lower surface 95*b* engages the lower surface of key 92.

The running string is then rotated clockwise (looking downward) to provide clockwise rotation of the mandrel 12 until the key engages stop surface 101. Stop surface 100 is not engaged because the mandrel 12 was pulled up until the key 92 engages the lower surface 95*b*.

Figure 2B:
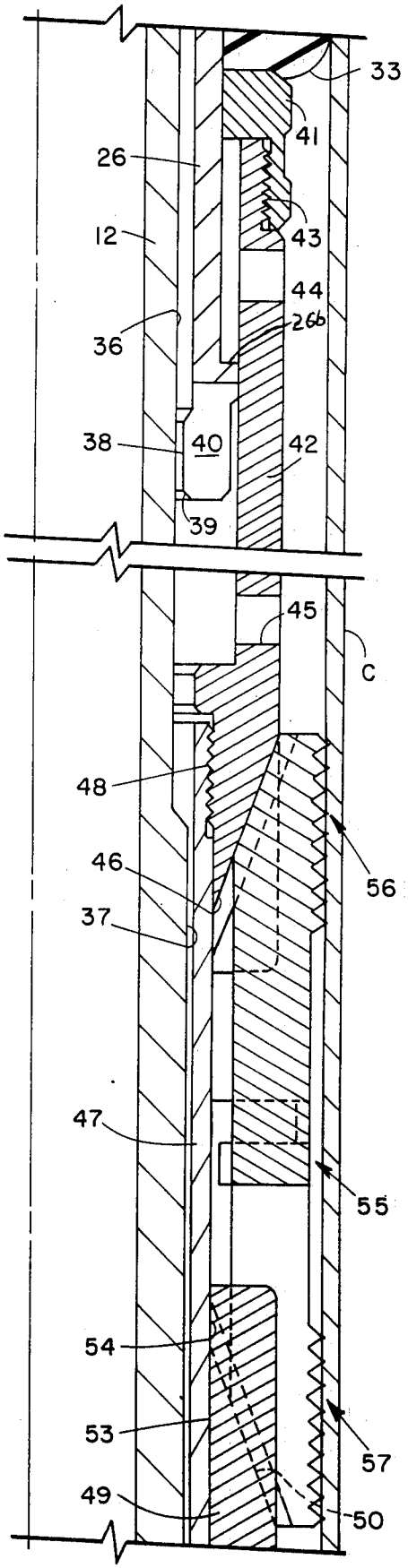
FIGS. 2*a*, 2*b*, 2*c* and 2*d* are cross-sectional portions of the apparatus showing it in its set and packed off condition.

The running string is then slacked off which causes it and mandrel 12 to lower relative to key 92 which is held stationary through the friction of the drag blocks against the casing. The threads 89 on the segments 86 are ratcheted over the threads 90 on the mandrel 12. As the mandrel 12 moves downwardly the inclined camming surfaces 46 and 50 engage the camming surfaces 61 on the slips 56 and 57. The teeth 60 on the lower slips 57 are engaged with the inner wall of the casing C as shown in FIG. 2*b*.

Figure 1A:
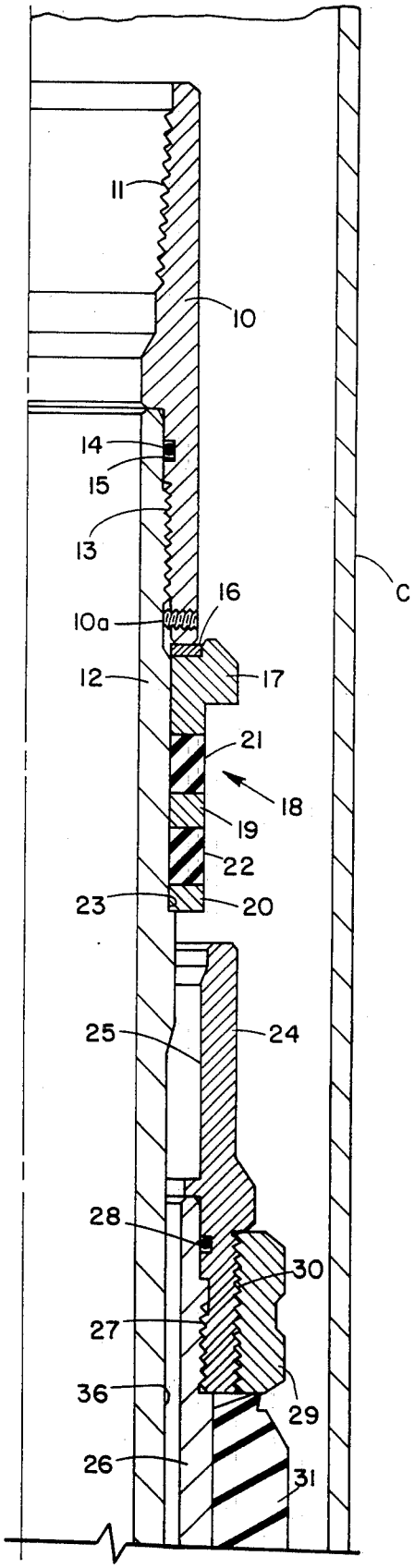
Figure 2A:
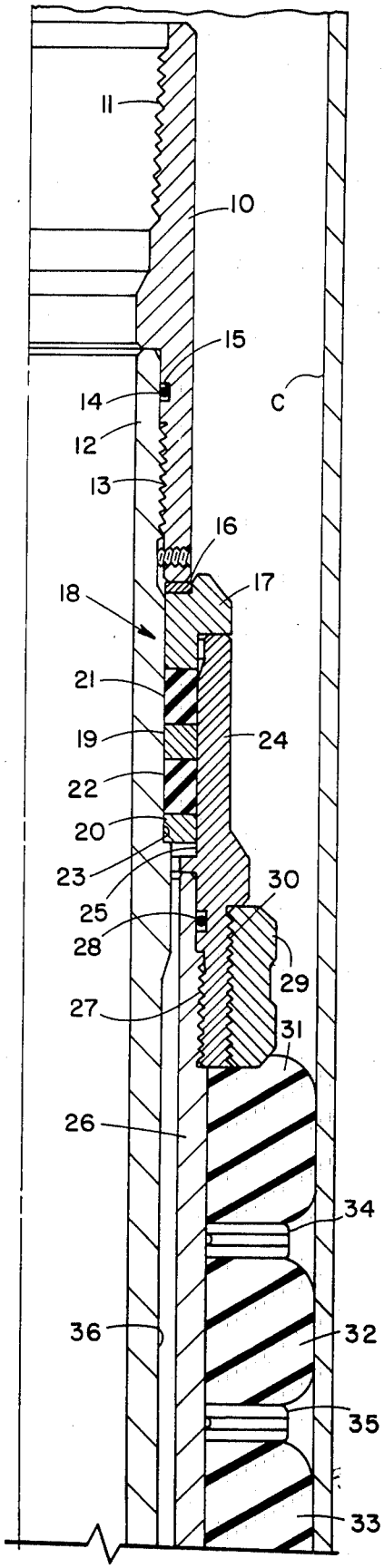
Figure 1C:
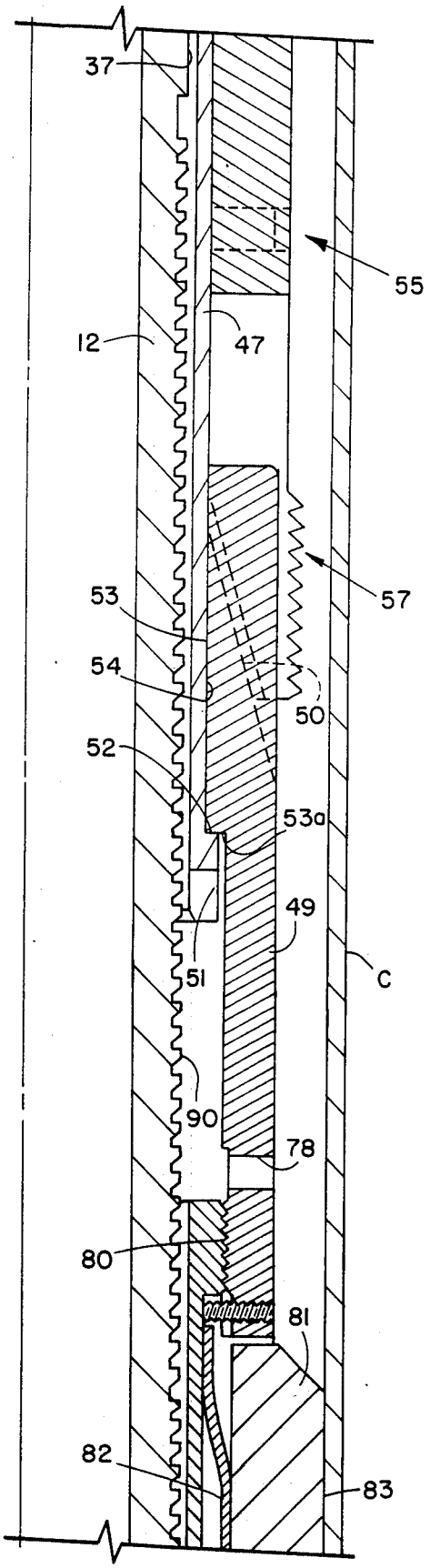
Figure 2C:
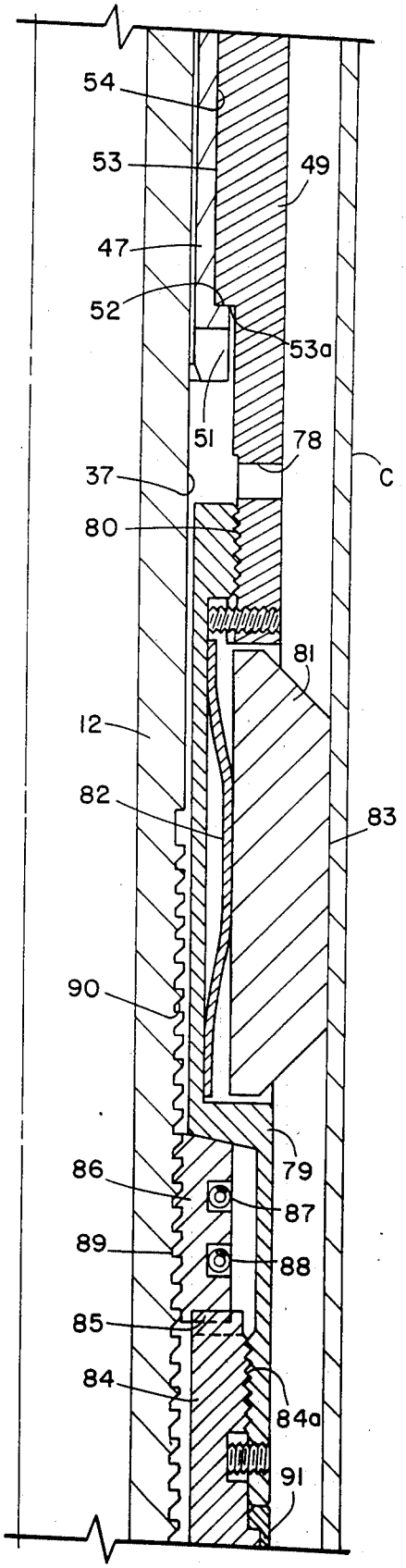
Figure 1D:
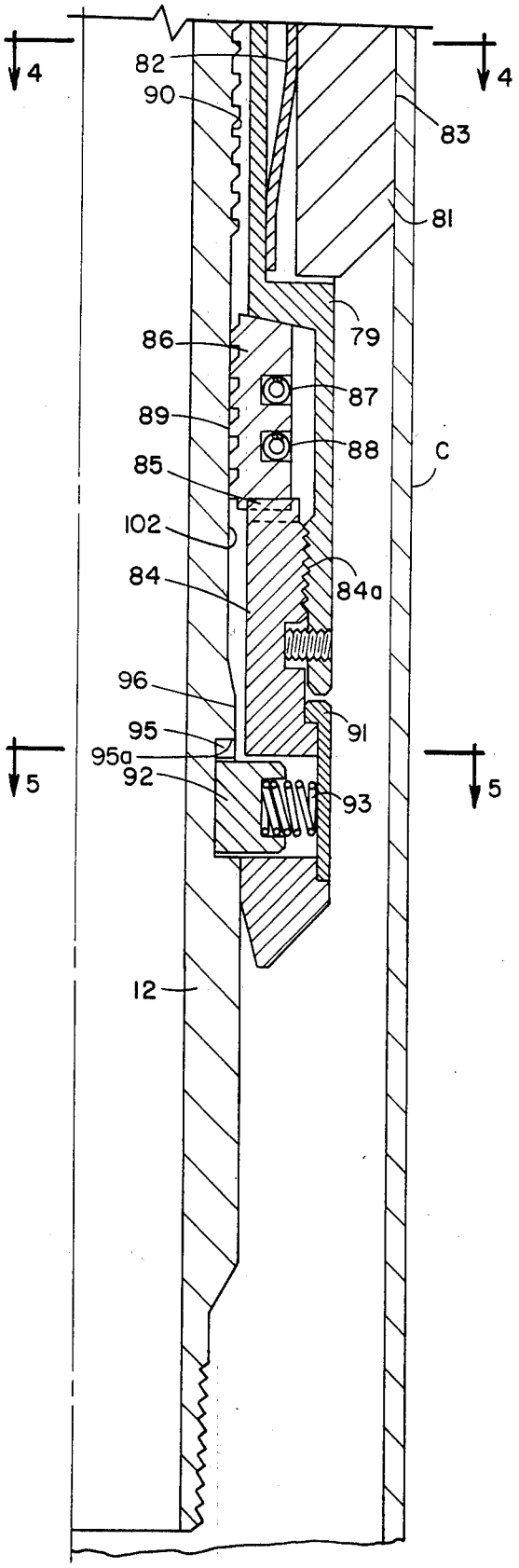
Figure 2D:
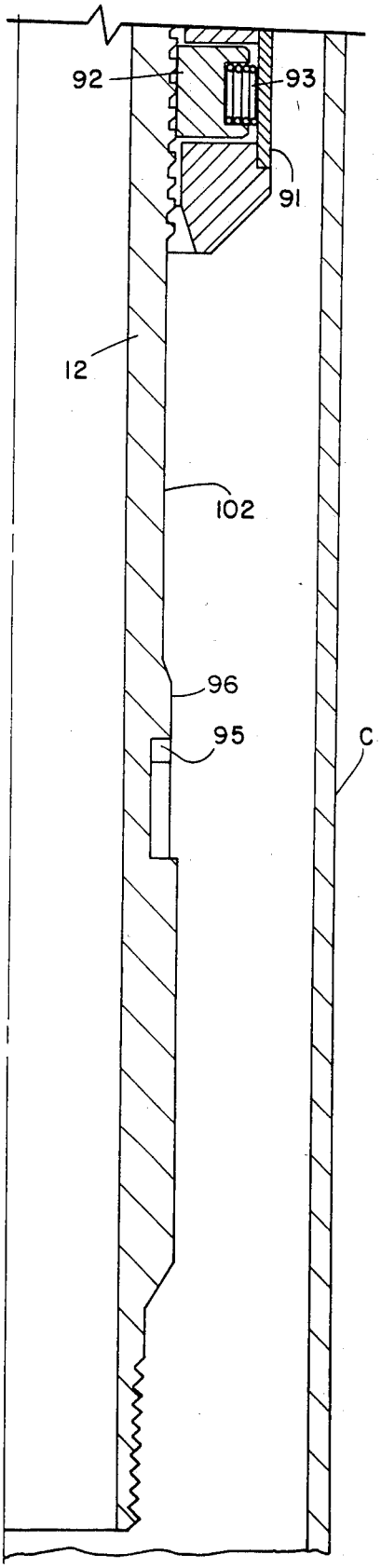
Figure 3A:
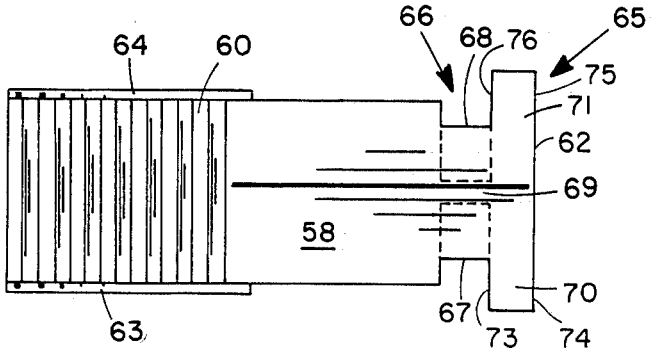
FIG. 3*a* is a plan view of a slip.
Figure 3B:
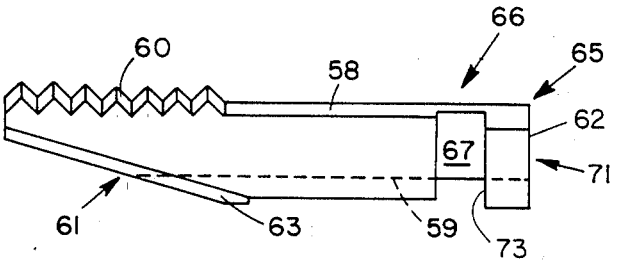
FIG. 3*b* is a side view of a slip.
Figure 3D:
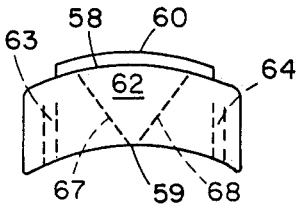
FIG. 3*d* is an end view of the interlocking means of a slip.
Figure 3C:
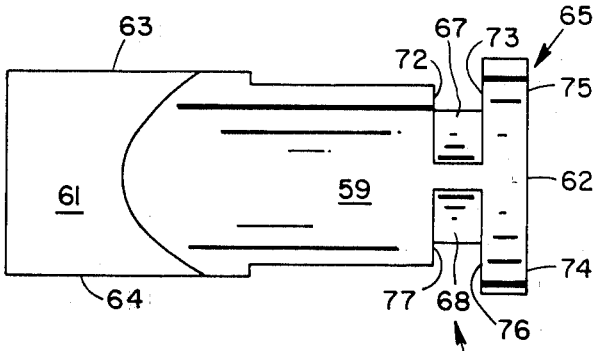
FIG. 3*c* is a lower plan view of the back of a slip.
Figure 3E:
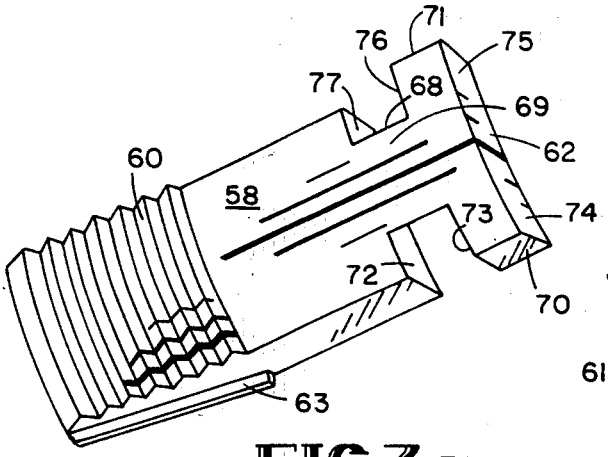
FIG. 3*e* is a perspective view of the front of the slip.
Figure 3F:
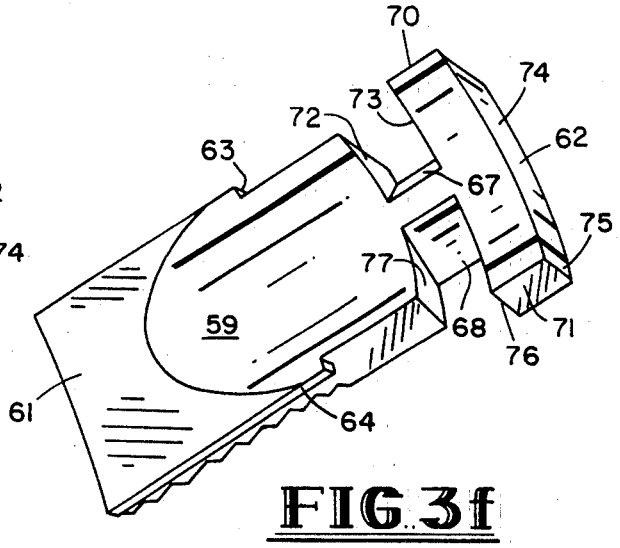
FIG. 3*f* is a plan view of the back of a slip.
Figure 4:
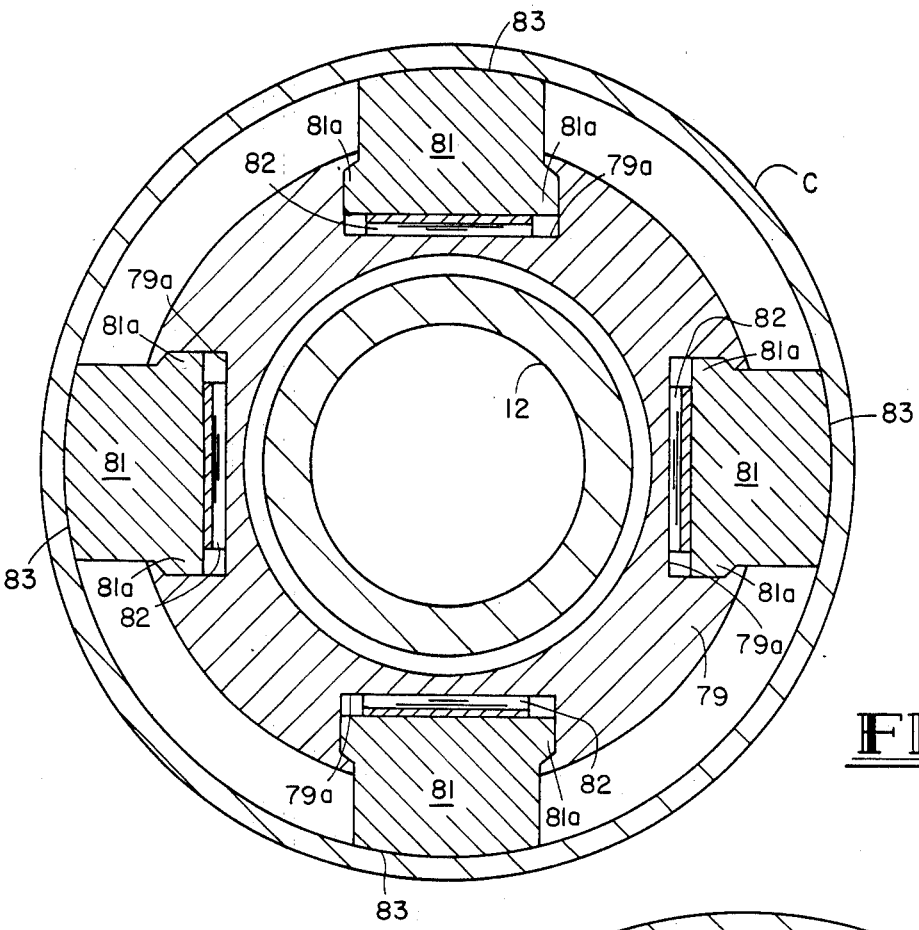
FIG. 4 is a cross-sectional view showing the drag block means.

As shown in FIGS. 1*a* and 2*a* the seal housing 24 comes into engagement with the packing elements 21 and 22 to close the bypass seal at which time the seal housing 24 engages the bearing retainer 17. Continued downward movement of the mandrel 12 will squeeze the cylindrical elastomer members or packing elements 31, 32 and 33 outwardly until they engage the inner wall of the casing C as shown in FIGS. 2*a* and 2*b*. This seals the annulus between the apparatus and the casing. Approximately 10,000 to 12,000 pounds force may be applied to a seven-inch apparatus to pack it off as shown in FIGS. 2*a*, 2*b*, 2*c* and 2*d*. The amount of force may vary according to the size of the tool.

Figure 9:
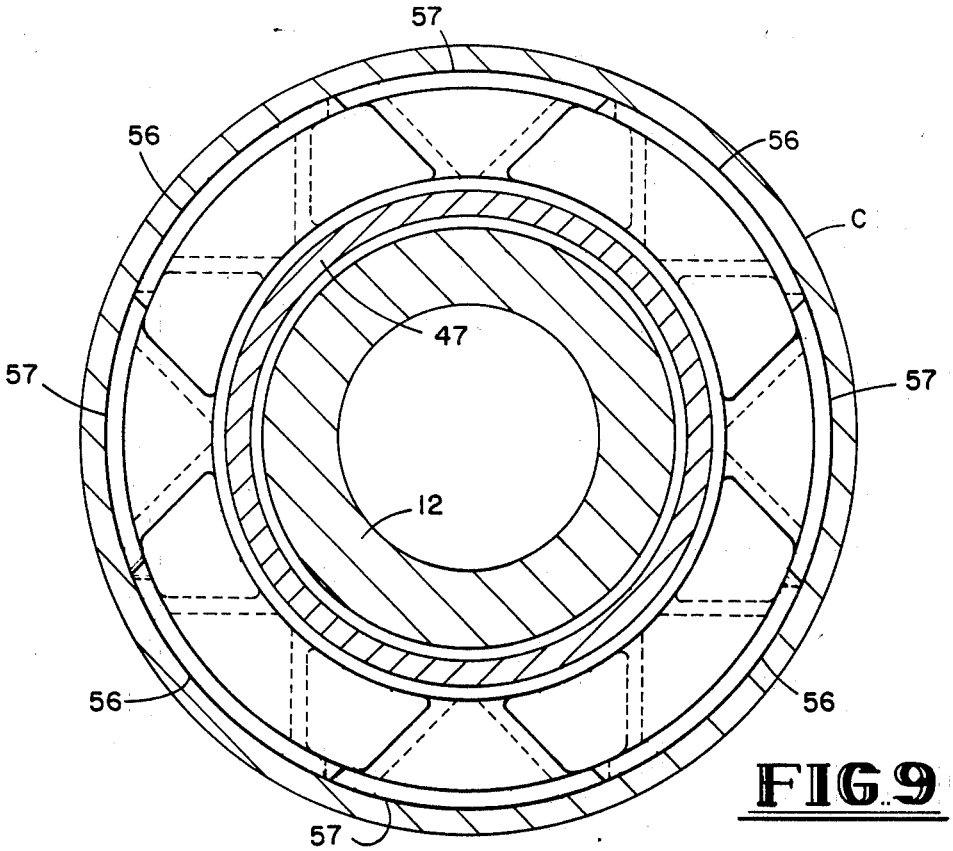
FIG. 9 is a cross-sectional view looking downwardly showing the upper and lower slips engaged.

The running string is then lifted upwardly to insure that the lower slip means 57 engages the inner wall of the casing as shown in FIG. 9. Approximately 10,000 to 12,000 pounds upward force is applied to the running string to insure that the lower slips of a seven-inch apparatus are firmly engaged with their teeth 60 in contact with the inner wall of the casing C. The tool is then in its set position because the teeth 89 have ratcheted over the teeth 90 which locks the mandrel 12 against movement relative to the segments 86 to maintain the tool in its locked position.

When it is desired to release the tool, the tool is rotated clockwise which causes relative movement between the teeth 90 and the teeth 89 and which provides downward movement of the segments 86 relative to the mandrel 12. This results in return of the tool to the position shown in FIGS. 1*a*, 1*b*, 1*c* and 1*d*. The inclined camming surfaces 46 and 50 are moved away from each other which retract the upper and lower slips 56 and 57. The packing elements 31, 32 and 33 are slacked off which allows them to disengage the inner wall of the casing C due to their resiliency. The seal housing 24 is lowered relative to the mandrel 12 till it returns to the position shown in FIG. 1*a*. As the apparatus bottoms out, the key 92 is biased outwardly over the upset portion 96 assuming it is not in line with the removed portion 97. This returns the key 92 to the slot 95. Counterclockwise rotation of the running string and mandrel 12 will again position the key 92 in engagement with the stop surface 99 which is the fully locked position. The apparatus may be removed from the well casing in that the upper and lower slip means 56 and 57 are disengaged and the packing elements 31, 32 and 33 are also disengaged.

During the lowering operation it may be necessary to rotate the running string which also rotates the apparatus. As long as the key 92 engages the lower surface 95*a* of the slot 95 the apparatus can not be collapsed to its packed in position and it will not jam up which may prevent movement in the casing. The key 92 will engage the stop surface 99 or the stop surface 100 to prevent collapsing of the tool to its packed position. Accordingly it is possible to rotate the running string clockwise and counter-clockwise, without slacking off on the running string, while still preventing packing in of the tool. The key 92 avoids inadvertent setting of the tool since in order to set the tool the running string must first be lifted upwardly so that rotation of the running string will not engage the key 92 with the stop surface 100 but rather will engage it with the stop surface 101 which permits setting of the tool. When the tool is being run into a casing, power tongs are often used to rotate the string so applicant's invention prevents presetting during this running-in operation.

As set forth above, the upper and lower slips 56 and 57 provide more than 360° bite due to an overlap as shown in FIG. 9. This is possible due to the interconnecting means 65. The engaging surfaces on the interconnecting means 65 retain considerable overlap even when in the engaged position. The interconnecting surfaces of the interconnecting means maintain substantial contact when the slips are set to withstand relative longitudinal forces applied to the upper and lower slip.

Although the invention has been described in conjunction with the foregoing specific embodiment, many alternatives, variations and modifications will be apparent to those of ordinary skill in the art. Those alternatives and modifications are intended to fall within the spirit and scope of the appended claims.

We claim:

1. A method for running in, setting and retrieving a subsurface well conduit engaging apparatus comprising:

lowering the well conduit engaging apparatus into a well conduit to a desired location;

rotating the well conduit engaging apparatus in clockwise and counterclockwise directions without unlocking the engaging means for setting the apparatus in the well casing;

unlocking the engaging means for engagement with a well conduit by raising and then rotating an elongate support means upon which engaging means are mounted to position a radially biased key to its unlocked position for allowing relative longitudinal motion between the support means and the engaging means;

thereafter raising the support means to fully engage the well casing; and relocking the engaging means from engagement with the well casing by raising the support means without rotation to position the key in its locked position.

2. The method of claim 1 including the step of disengaging the engaging means upon rotation of the support means.

3. The method of claim 1 including the step of stopping the rotation of the support means in both directions without unlocking the engaging means.

4. The method of claim 3 including the step of raising the support means and engaging a third stop means upon rotation of the support means to unlock the engaging means.

5. The method of claim 1 including rotating the support means in the counterclockwise direction before the engaging means is relocked.

6. A method for running in, setting and retrieving a well packer in a well casing comprising:

lowering the well packer into a well casing to a desired location;

raising the support means of said well packer;

rotating the support means of said well packer until the support means engages a stop on the engaging means of said well packer;

thereafter exerting upward force on the support means to cause the engaging means to fully engage the well casing and relative longitudinal movement between the support means and the engaging means thereby unlocking the support means from the engaging means; and releasing the engaging means from engagement with the well casing by rotating the support means and then raising the support means to position the key in the locked position.

7. The method of claim 6 wherein the key is retained in the locked position by a stop surface on the engaging means.

8. The method of claim 7 wherein the support means is rotated in a clockwise direction until the key is positioned relative to the stop surface so as to allow movement of the key out of the locked position when upward force is not being exerted on the support means and the support means is allowed to move longitudinally relative to the engaging means.

9. The method of claim 6 wherein the key is moved outwardly over the stop surface when the support means is raised to return the key to the locked position.

10. A retrievable subsurface conduit engaging apparatus comprising:

an elongate support means for running into a subsurface conduit having a raised portion thereon;

the raised portion of said support means having a recessed locking slot therein, said locking slot including stop means and a longitudinal recess;

means for releasably engaging the wall of the subsurface conduit;

an inwardly biased, radially movable key on said engaging means selectively movable from a locked position in said locking slot to an unlocked position out of said locking slot by rotation of said support means followed by longitudinal movement of said support means in a first direction relative to said engaging means, causing said key to engage the stop means to said locking slot and then move through the longitudinal recess thereof out of said locking slot, said key being in said locked position when said engaging means is in running in position and in said unlocked position when said engaging means is in said set position; and means on said support means operable to bias said key outwardly over the raised portion of said support means to return said key to said locked position upon longitudinal movement of said support means in a second direction relative to said engaging means.

11. The apparatus of claim 10 wherein said locking slot extends substantially circumferentially around said support means.

12. The apparatus of claim 10 wherein said locking slot includes first and second stop means to allow rotation of said support means in either direction without setting said engaging means.

13. The apparatus of claim 10 wherein said locking slot includes third stop means for positioning said key operable to allow said key to be removed from said locking slot for setting said engaging means.

14. The apparatus of claim 10 wherein said support means and said engaging means are provided with mating threads operable to set said engaging means upon said longitudinal movement of said support means and to release said engaging means upon rotational movement of said support means relative to said engaging means.

* * * * *